US008467691B2

(12) United States Patent
Hanashi

(10) Patent No.: US 8,467,691 B2
(45) Date of Patent: Jun. 18, 2013

(54) IMAGE FORMING APPARATUS INCLUDING TWO SENSORS FOR DETECTING TONER IMAGE DENSITY

(75) Inventor: Ryo Hanashi, Moriya (JP)

(73) Assignee: Canon Kabushiki Kaisha, Tokyo (JP)

( * ) Notice: Subject to any disclaimer, the term of this patent is extended or adjusted under 35 U.S.C. 154(b) by 322 days.

(21) Appl. No.: 12/909,160

(22) Filed: Oct. 21, 2010

(65) Prior Publication Data

US 2011/0103815 A1 May 5, 2011

(30) Foreign Application Priority Data

Oct. 29, 2009 (JP) ..... 2009-249257
Sep. 28, 2010 (JP) ..... 2010-217865

(51) Int. Cl.
*G03G 15/00* (2006.01)

(52) U.S. Cl.
USPC ..... 399/49

(58) Field of Classification Search
USPC ..... 399/38, 46, 49, 297, 298, 301–303
See application file for complete search history.

(56) References Cited

U.S. PATENT DOCUMENTS 7,693,468 B2 * 4/2010 Ehara et al. ..... 399/301
7,881,629 B2 * 2/2011 Takeuchi et al. ..... 399/59

FOREIGN PATENT DOCUMENTS

JP 2000-198568 A 7/2000
JP 2000-337464 A 12/2000
JP 2003-84532 A 3/2003

* cited by examiner

*Primary Examiner* — Hoan Tran
(74) *Attorney, Agent, or Firm* — Fitzpatrick, Cella, Harper & Scinto

(57) ABSTRACT

An image forming apparatus includes a belt; a plurality of rollers for stretching the belt; a mechanism for generating a force, at an end portion of the belt, in a direction in which lateral deviation of the belt is corrected; a forming device for forming a toner image on the belt; a first sensor capable of detecting a density of the toner image formed on the belt on one end side of the belt; a second sensor capable of detecting the density of the toner image formed on the belt on the other end side of the belt; and a control device for selecting one of the first and second sensors which provides smaller variation in a result of detection when the belt is free from the toner image, and for controlling an image forming condition of the forming device on the basis of a detection result of the density of the toner image by the selected sensor.

9 Claims, 12 Drawing Sheets

(a)

(b)

(a)

(b)

(a)

(b)

(a)

(b)

IMAGE FORMING APPARATUS INCLUDING TWO SENSORS FOR DETECTING TONER IMAGE DENSITY

FIELD OF THE INVENTION AND RELATED ART

The present invention relates to an image forming apparatus including a belt for carrying a toner image.

In recent years, in an electrophotographic image forming apparatus, an intermediary transfer type in which the toner image formed on a photosensitive member is transferred onto an intermediary transfer member and then is transferred from the intermediary transfer member onto a sheet has been employed. Further, as the intermediary transfer member, an intermediary transfer belt which is liable to be freely disposed in the image forming apparatus has been positively employed in products.

Thus, the intermediary transfer belt can be disposed relatively freely but on the other hand, causes a problem such that the intermediary transfer belt is laterally deviated or shifted when axes of at least two rollers for stretching the intermediary transfer belt is out of alignment (hereinafter referred to as belt lateral deviation). A method of correcting (suppressing) the belt lateral deviation will be described below based on examples.

Japanese Laid-Open Patent Application (JP-A) 2000-198568 discloses a method in which a belt is shifted in a direction in which the position of the belt is returned to a normal position (meandering is suppressed) by detecting the belt lateral deviation and tilting a plurality of rollers for stretching the belt by vertically moving end portions of the rollers through a motor or a solenoid.

JP-A 2000-337464 discloses a method in which a regulating rib for regulating the belt lateral deviation is provided on the intermediary transfer belt. Specifically, the regulating rib is provided at end portions of the intermediary transfer belt and contacts the roller for stretching the intermediary transfer belt, so that the intermediary transfer belt is regulated so as not to be further deviated laterally.

Incidentally, a density of an image to be formed by the image forming apparatus fluctuates due to a change in environment or long-term use. In the case of a full-color image, a color balance (coloring) is destroyed by the density fluctuation and therefore it is desirable that a density characteristic (gradation-density characteristic) of an image to be outputted in kept.

A method in which the density of the toner image actually formed on the intermediary transfer belt is measured in order to keep the density characteristic has been known (JP-A 2003-84532). Specifically, a test toner image (patch image) for density correction is formed on the intermediary transfer belt and then the density of the unfixed toner image is detected by a density detection sensor provided at a central portion of the intermediary transfer belt with respect to a main scan direction. Then, on the basis the density (detection result) detected by the density detection sensor, a process condition such as an amount of exposure or a developing bias has been changed.

In an image forming apparatus including a belt lateral deviation correcting mechanism, such a problem that accuracy of density control is lowered when an image forming condition is adjusted by a patch (image) for density adjustment occurred.

SUMMARY OF THE INVENTION

A principal object of the present invention is to provide an image forming apparatus capable of suppressing a lowering in density detection accuracy of a patch image caused due to bending of a belt even in a constitution in which the image forming apparatus includes a mechanism for applying a force, at an end portion of the belt, in a direction in which lateral deviation of the belt is corrected or alleviated.

According to an aspect of the present invention, there is provided an image forming apparatus comprising:

a belt;

a plurality of rollers for stretching the belt;

a mechanism for generating a force, at an end portion of the belt, in a direction in which lateral deviation of the belt is corrected;

a forming device for forming a toner image on the belt;

a first sensor capable of detecting a density of the toner image formed on the belt on one end side of the belt;

a second sensor capable of detecting the density of the toner image formed on the belt on the other end side of the belt; and a control device for selecting one of the first and second sensors which provides smaller variation in a result of detection when the belt is free from the toner image, and for controlling an image forming condition of the forming device on the basis of a detection result of the density of the toner image by the selected sensor.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Figure 1:
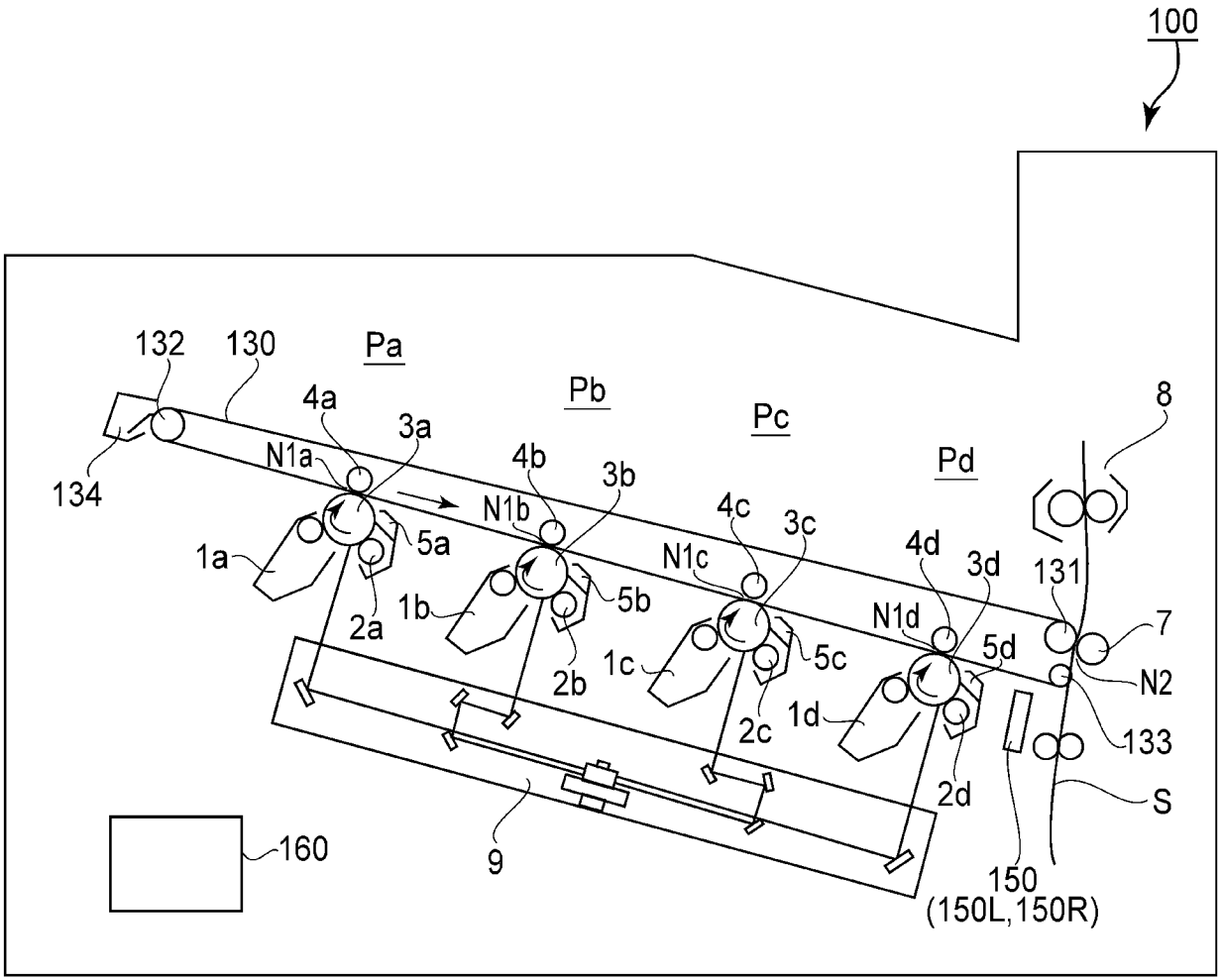
FIG. 1 is a schematic view for illustrating a structure of an image forming apparatus including an intermediary transfer belt.

Before description of a specific constitution, study process by the present inventor will be briefly described.

Compared with a constitution in which sensors are provided so that a density of a patch image can be detected on each of photosensitive members for a plurality of colors, a constitution in which the density is detected by sensors after patch images formed on the respective photosensitive members are transferred onto an intermediary transfer member is preferable since the number of the sensors can be decreased. However, when an intermediary transfer belt is used as the intermediary transfer member, belt lateral deviation occurs.

It would be considered that belt lateral deviation regulation is taken as countermeasure against the belt lateral deviation. However, in a constitution including a mechanism for correcting (regulating) the lateral deviation of the intermediary transfer belt, when a process condition is changed on the basis of the density of the patch image formed at a central portion of the intermediary transfer belt with respect to a main scan direction, the following problem arises.

Specifically, when the intermediary transfer belt is shifted to one end side of a roller, the intermediary transfer belt is bent by a force exerted on the intermediary transfer belt in a direction in which the position of the intermediary transfer belt is returned to the normal position (a direction in which the intermediary transfer belt is moved from one end side to the other end side). The bending (or vibration) generated at an end portion on the side where the force for returning the position of the intermediary transfer belt to the normal position (i.e., the force for correcting the lateral deviation) is applied to the intermediary transfer belt is transmitted to a central portion of the intermediary transfer belt with respect to a main scan direction of the intermediary transfer belt. For that reason, in the case where the patch image density is detected at the main scan direction central portion of the belt (intermediary transfer belt) carrying the toner image, there arises such a problem that accuracy of density detection by a sensor is lowered due to the transmitted bending.

Hereinafter, the constitution described in JP-A 2000-337464 in which the regulation rib is provided on the intermediary transfer belt will be described as an example. In the constitution of JP-A 2000-337464, in the case where the intermediary transfer belt is laterally deviated (shifted) in a one end direction of a roller for stretching the intermediary transfer belt, the regulation rib provided on the other end side contacts the roller. At that time, the intermediary transfer belt receives a force in a direction in which the intermediary transfer belt is moved from one end side to the other end side by the contact of the other end-side regulation rib with the roller. Here, the force generated by the contact of the other end-side regulation rib with the roller, the other end side of the intermediary transfer belt is bent. This bending of the other end-side intermediary transfer belt is transmitted to the central portion, so that reading accuracy of the patch image at the central portion is lowered. For that reason, this problem is solved by the constitution described below.

Hereinbelow, the image forming apparatus according to the present invention will be described specifically with reference to the drawings.

Embodiment 1

Image Forming Apparatus

First, when reference to FIG. 1, a general structure of the image forming apparatus in this embodiment of the present invention will be described. An image forming apparatus 100 in this embodiment is a tandem type color image forming apparatus of an electrophotographic type.

The image forming apparatus 100 includes four image forming portions contacting an image forming means, i.e., first, second, third and fourth image forming portions Pa, Pb, Pc and Pd. The first to fourth image forming portions Pa to Pd are juxtaposed along a movement direction a transfer surface of toner images on an intermediary transfer belt 130. The image forming portions Pa, Pb, Pc and Pd form toner images of yellow, cyan, magenta and black, respectively, through process of latent image formation, development and transfer.

Incidentally, constitutions and operations of the image forming portions Pa to Pd are substantially identical to each other except that the colors of toners used are different from each other. Therefore, in the case where there is no need to particularly differentiate the image forming portions, suffixes a, b, c and d added to reference numerals or symbols for representing constituent elements of either one of the image forming portions will be omitted, and the constituent elements of the image forming portions will be collectively described.

The image forming portion P includes a drum-like electrophotographic photosensitive member as a first image bearing member, i.e., a photosensitive drum 3. Around the photosensitive drum 3, the following means are provided. That is, a charging device 2 as a charging means, a developing device 1 as a developing means, a primary transfer roller 4 as a primary transfer means, and a photosensitive member cleaner 5 as a cleaning means are provided. Further, at a lower portion inside an image forming apparatus main assembly, an exposure device 9 as an exposure means is provided, so that image exposure of the respective photosensitive drums 3*a* to 3*d* of the image forming portions Pa to Pd is effected by this exposure device 9.

The intermediary transfer belt 130 as a second image bearing member which is an endless belt-like intermediary transfer member is disposed opposed to the photosensitive drums 3*a* to 3*d* of the image forming portions Pa to Pd. The respective primary transfer rollers 4*a* to 4*d* are disposed on an inner surface of the intermediary transfer belt 130 and oppose the respective photosensitive drums 3*a* to 3*d* through the intermediary transfer belt 130. Thus, the intermediary transfer belt 130 contacts the photosensitive drums 3*a* to 3*d* to form primary transfer portions N1*a*, N1*b*, N1*c* and N1*d*, respectively. Further, on an outer surface of the intermediary transfer belt 130, a secondary transfer roller 7 as a secondary transfer means is provided. The secondary transfer roller 7 contacts the surface of the intermediary transfer belt 130 to form a secondary transfer portion N2.

During image formation, the surface of rotating photosensitive drum 3 is uniformly charged to a predetermined polarity (negative in this embodiment) and a predetermined potential. The surface of the changed photosensitive drum 3 is subjected to image exposure depending on an image information signal by the exposure device 9, so that an electrostatic latent image (electrostatic image) is formed on the surface of the photosensitive drum 3. The electrostatic latent image formed on the photosensitive drum 3 is developed as a toner image by depositing transfer of a developer on the surface of the photosensitive drum 3 by the developing device 1. In this embodiment, at an exposed portion, where electric charge is attenuated by the image exposure, on the uniformly charged surface of the photosensitive drum 3, the toner charged to an identical polarity to the charge polarity of the photosensitive drum 3 is deposited, so that the toner image is formed (reverse development).

The toner image formed on the photosensitive drum 3 is (primary-)transferred in the primary transfer portion onto the surface of the intermediary transfer belt 130 as the belt-like image bearing member provided adjacent to the photosensitive drum 3. For example, during full-color image formation, toner images for respective colors formed on the surfaces of the photosensitive drums 3*a* to 3*d* of the first to fourth image forming portions Pa to Pd are successively (primary-)transferred superposedly onto the surface of the intermediary transfer belt 130 which is moved.

The toner image formed on the surface of the intermediary transfer belt 13 is (secondary-)transferred onto a recording material S, which has been fed from an unshown recording material feeding portion and then conveyed through a conveying path, at a secondary transfer portion N2 by the secondary transfer roller 7.

The recording material S on which the toner image is transferred is sent to a fixing device 8 as a fixing means in which the recording material S is heated and pressed, so that the toner image is fixed on the recording material S, which is then discharged outside the image forming apparatus.

In this embodiment, the image forming apparatus 100 can form the image at a process speed (corresponding to a surface-movement speed of the photosensitive drum and the intermediary transfer belt) of 150 mm/sec and a throughput of 35 sheets/min. Further, in this embodiment, a maximum image with respect to the main scan direction is 310 mm, and the image is formed on a center line basis with respect to the main scan direction.

In this embodiment, the intermediary transfer belt 130 has a circumferential length (sub-scan direction) of 700 mm and a width (main scan direction) of 350 mm. Further, in this embodiment, as the intermediary transfer belt 130, a polyimide seamless belt which has been subjected to electroconductivity treatment.

On the inner surface side of the intermediary transfer belt 130, a belt supporting member (not shown) molded by a resin material is disposed and thereon, primary transfer rollers 4*a* to 4*d*, a tension roller 132, a driving roller 131 and a follower roller 133 are disposed. The intermediary transfer belt 130 is extended and stretched around three axes (shafts) of the follower roller 133, the tension roller 132, and the driving roller (inner secondary transfer roller) 131 functioning as a drive transmitting member and an opposing member of the secondary transfer roller 7.

The tension roller 132 applies predetermined tension to the intermediary transfer belt 130 by exerting an urging force on the intermediary transfer belt 130 from the inner peripheral surface toward the other peripheral surface by an urging spring (not shown). The driving roller 131 is disposed opposite to the secondary transfer roller 7 and forms a nip (secondary transfer portion) N2 suitable for nip-conveyance of the recording material S between itself and the secondary transfer roller 7 through the intermediary transfer belt 130. The driving roller 131 has a drive transmitting function for rotating the intermediary transfer belt 130 by a frictional force between itself and the intermediary transfer belt 130.

In this embodiment, the primary transfer roller 4 is formed by bonding a sponge of EPDM to an aluminum core metal. The primary transfer roller 4 has an outer diameter of 14 mm and a hardness of about 14 degrees (Asker C hardness, 500 gf) and is pressed against the intermediary transfer belt 130 at pressure of 0.8N, thus being rotated by the intermediary transfer belt 130. To the primary transfer roller 4, it is possible to apply a predetermined high voltage (primary transfer bias) from an end portion of the core metal through an electroconductive bearing.

In this embodiment, the driving roller 131 is an aluminum hollow roller coated with a layer of NBR. A shaft of the driving roller 131 is passed through the bearing held by the belt supporting member, and at an end portion of the shaft, a gear is disposed. The driving roller 131 is rotated at a predetermined speed by receiving a driving force supplied from a motor of the apparatus main assembly and transmits the driving force to the intermediary transfer belt 130 by a frictional force between the surface NBR layer and the inner peripheral surface of the intermediary transfer belt 130, thus rotating the intermediary transfer belt 130. The shaft of the driving roller 131 is electrically grounded and forms a bias path between itself and the secondary transfer roller 7 which is disposed opposed to the driving roller 131 through the intermediary transfer belt 131 and which is supplied with a secondary transfer bias.

In this embodiment, the follower roller 133 is an aluminum hollow roller, and it shaft is passed through the bearing held by the belt supporting member, so that the follower roller 133 is rotated by the intermediary transfer belt 130. The follower roller 133 is disposed so that the movement direction of the intermediary transfer belt 130 sandwiched between the primary transfer roller 4 and a lowermost-stream image forming portion Pd with respect to the movement direction of the intermediary transfer belt 130 is an optimum direction for the primary transfer. Further, the stretched intermediary transfer belt 130 between the follower roller 133 and the secondary transfer roller 7 is also disposed at an optimum position.

At the outer peripheral surface of the intermediary transfer belt 130, in addition to the photosensitive drums 3*a* to 3*d* of the image forming portions Pa to Pd and the secondary transfer roller 7, a belt cleaning member 134 for collecting the toner (secondary transfer residual toner) remaining on the surface of the intermediary transfer belt 130 after the secondary transfer is disposed in a contact state.

In this embodiment, the secondary transfer roller 7 is formed with an electroconductive sponge of 24 mm in an outer diameter and press-contacts the intermediary transfer belt 130 toward the driving roller 131 at its end portions with respect to its axial direction at a pressure of 2.5N on each side. The secondary transfer roller 7 is provided with a gear at an end portion of its shaft and receives the driving force from the apparatus main assembly through the gear, thus being rotated with a speed difference with respect to a peripheral speed (surface movement speed) of the intermediary transfer belt 130. To the core metal of the secondary transfer roller 7, a predetermined high voltage (secondary transfer bias) can be applied and is applied during the secondary transfer.

In this embodiment, the belt cleaning member 134 is a plate-like cleaning blade of urethane rubber. The belt cleaning member 134 is disposed, at a position opposing the tension roller 132, counterdirectionally to the surface movement direction of the intermediary transfer belt 130, and contacts the intermediary transfer belt 130 at the pressure of 1.0N.

Figure 8:
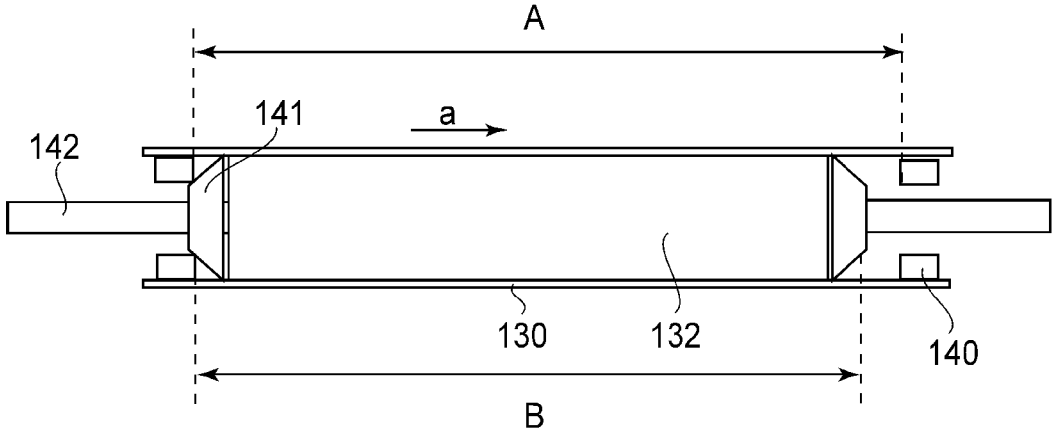
FIGS. 8(*a*) and 8(*b*) are sectional views for illustrating a lateral deviation regulating (preventing) mechanism for the intermediary transfer belt.
Figure 8:
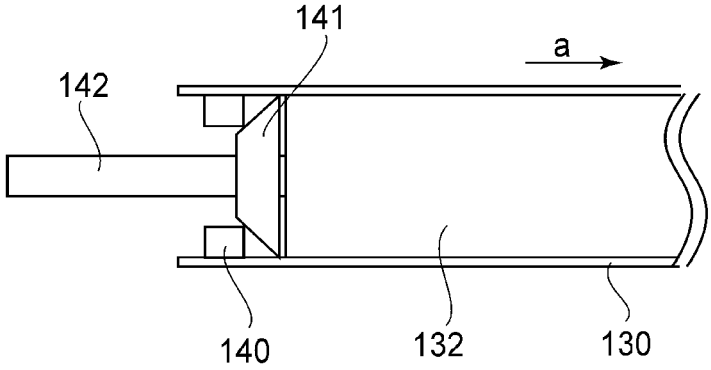

FIG. 8(*a*) is a general view for illustrating a state in which the intermediary transfer belt is stretched by the roller. FIG. 8(*b*) is an enlarged view of one end portion of the roller. As shown in these figures, at the axial end portion of the tension roller 132, a tapered regulating member 141 is provided. When the intermediary transfer belt 130 is moved in a direction indicated by an arrow a (main scan direction), a regulating rib 140 provided on the intermediary transfer belt 130 so as to be projected from the inner peripheral surface in the neighborhood of the end portion with respect to the main scan direction of the intermediary transfer belt 130 abuts against the regulating member 141. As a result, the movement of the intermediary transfer belt 130 in the main scan direction is suppressed. Incidentally, as shown in FIG. 8(*a*), a distance A from the rib provided on one end side on the inner surface (contacting the stretching roller) of the intermediary transfer belt to the rib provided on the other end side is shorter than a distance B from the rib provided on one end side to the end of the tapered regulating member 141 on the other end side. As a result, the roller and the rib provided on the inner surface of the belt contact each other only on one side.

(Optical Sensor)

The image forming apparatus 100 in this embodiment effects both of the density correction control and registration control as described above. The density correction control is effected in order to obtain a constant gradation-density characteristic even when characteristics of respective portions of the image forming apparatus are changed. In the density correction control, patch images as test toner images for density correction control are formed on the intermediary transfer belt by using transfers of respective colors and on the basis of a result of each of the toner image densities optically detected by a density detecting sensor, a change or the like of a process condition such as an amount of exposure or a developing bias is made. Further, the registration control is effected in order to uniformly position the toner images formed by the image forming portions Pa to Pd. In the registration control, a plurality of registration detection patterns as test toner images for the registration control and on the basis of a result of each of the patterns optically detected by a registration detecting sensor, adjustment or the like of image forming timing for each color is mode. Incidentally, when the registration detecting sensor and the density detecting sensor are provided in a single package, compared with the case where the sensors are separately provided, the entire image forming apparatus can be downsized from the viewpoints of a substrate, wiring, and the like. Further, when the sensors are separately provided, compared with those provided in the single package, a cost is liable to increase. Further, in a constitution in which different substrates are mounted at different positions, an assembling cost and the number of members or the like required for supporting the sensors are increased, so that a total cost is liable to increase.

In the present invention, in the density correction control itself and in the registration control itself, any available methods such as known methods can be utilized.

Figure 7:
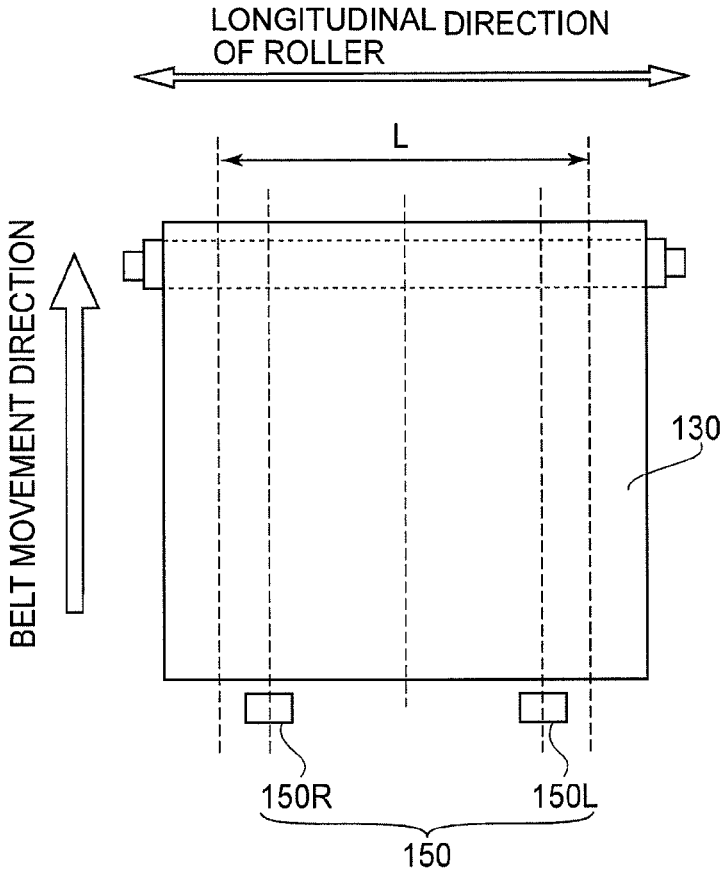
FIG. 7 is a schematic view for illustrating a positional relationship between the intermediary transfer belt and an optical sensor.

In the image forming apparatus 100 of this embodiment, at a downstream position of the lowermost-downstream image forming portion Pd with respect to the surface movement direction of the intermediary transfer belt 130, an optical sensor 150 as the detecting means is disposed opposed to the intermediary transfer belt 130. In this embodiment, first and second optical sensors as first and second detecting means for optically detecting the toner image formed on the surface of the intermediary transfer belt 130 at positions on one end portion side and on the other portion end side of the intermediary transfer belt 130 with respect to a direction perpendicular to the rotational direction of the intermediary transfer belt 130. That is, as the optical sensor 150, as shown in FIG. 7, two sensors, i.e., the first optical sensor 150L and the second optical sensor 150R are disposed in the neighborhood of end portions of an image area L with respect to the main scan direction. These first and second optical sensors 150L and 150R are used to effect both of the density correction control and the registration control.

Figure 6:
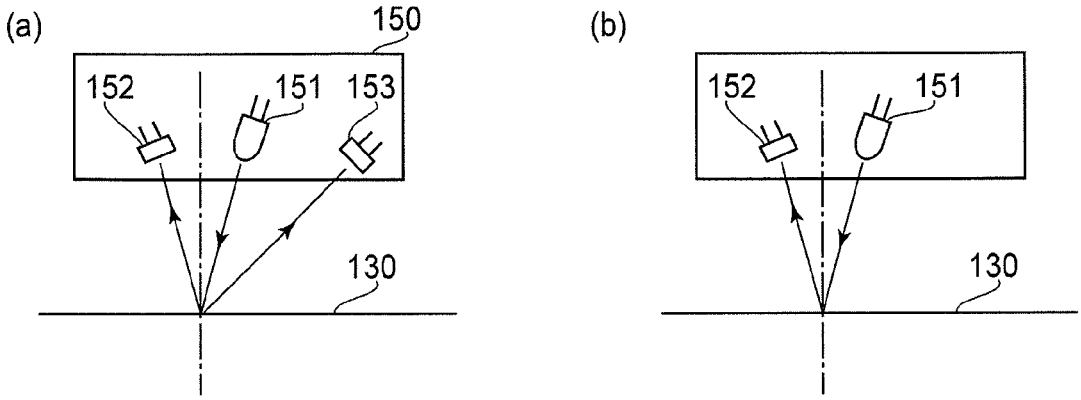
FIG. 6(*a*) is a schematic view for illustrating a constitution of a sensor for detecting specular reflection light and diffused light, and FIG. 6(*b*) is a schematic view for illustrating a constitution of a sensor for detecting the specular reflection light.

Each of the first and second optical sensors 150L and 150R is disposed so as to detect the position of 135 mm from the center line of the image area L on the intermediary transfer belt 130 with respect to the main scan direction. Both of the first and second optical sensors 150L and 150R are the optical sensor (reflectance sensor) capable of detecting the toner image density as shown in FIG. 6(*a*). Incidentally, as is also understood from FIG. 7, the optical sensors 150L and 150R are disposed along a longitudinal direction of the stretching roller and are both capable of detecting the patch formed in the image area on the intermediary transfer belt.

A distance between a reference surface of the optical sensor 150 (the first and second optical sensors 150L and 150R) and the intermediary transfer belt 130 is 10 mm. A light emitting portion (light emitting element) 151 for emitting light toward the surface of the intermediary transfer belt 130 is a infrared LEF of a peak wavelength of 940 nm set at an incident angle of 15 degrees. Further, each of a first light receiving portion (first light receiving element) 152 and a second light receiving portion (second light receiving element) 153 is a silicon (Si) photo-transistor having a peak sensitivity wavelength of 850 nm. The first light receiving portion 152 as the light receiving portion for a specular reflection light component is set at the incident angle of 15 degrees, and the second light receiving portion 153 as the light receiving portion for a diffused (reflection) light component is set at the incident angle of 45 degrees.

(Density Correction Control)

Figure 9:
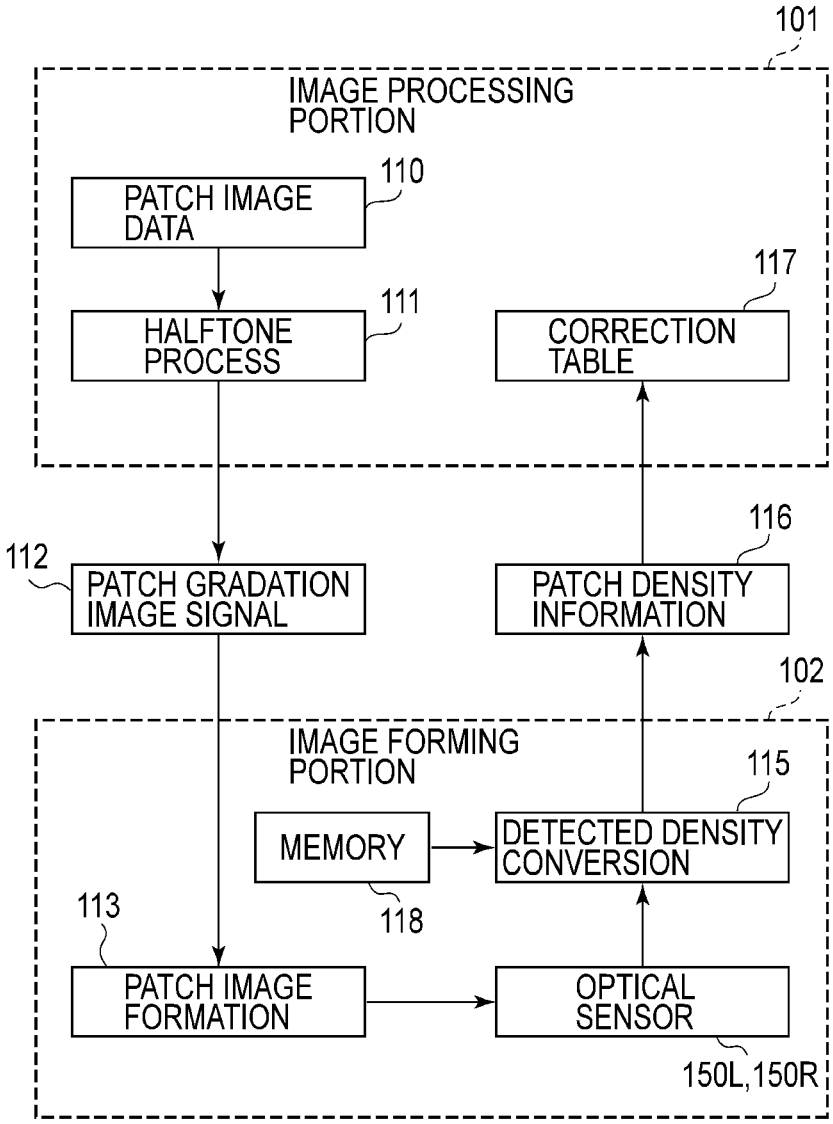
FIG. 9 is a block diagram of a control portion, provided in the image forming apparatus, for effecting density correction control.

The density correction control will be further described with reference to FIG. 9. By an execution instruction of the density correction control, a density correction control process is actuated. In an image processing portion 101, a described patch image data 110 is generated. The patch image data 110 includes 10 gradation levels for each color. The patch image data 110 is subjected to screen process by halftone process 111, so that a patch gradation signal 112 is prepared. The patch gradation signal 112 is transferred to an image forming portion 102, and a patch image 113 is formed on the intermediary transfer belt 130 by the image forming process described above. Then, by an optical sensor selected from the first and second optical sensors 150L and 150R, sampling of the specular reflection light component and the diffused light component of each patch image is made. A resultant measured value is converted into density information by a detected volume density conversion block 115, and the converted density information is transferred to the image processing portion 101 as patch density information. In the image forming portion 101, the patch density information is verified, so that a correction table is prepared.

The patch image is 15 mm in a length with respect to the main scan direction and 33 mm in a length with respect to the sub-scan direction. The sampling by the optical sensor 150 is made so that 10 points are sampled at a pitch of 20 msec from the position of 3 mm from a leading end of one patch image with respect to the movement direction.

The detected value density conversion block 115 removes a maximum and a minimum from the sampling result of 10 points set from the optical sensor 150 and subjects remaining sampled 8 points to averaging process to obtain a detected value of the patch image.

The optical sensor 150 detects the specular reflection light component and the diffused light component but from these signals, the density information is calculated in the detected value density conversion block 115.

The specular reflection light component provides a highest light receiving level in a state in which a substantially mirror surface of the intermediary transfer belt 130 is detected. A portion where the toner is deposited on the intermediary transfer belt 130 has an uneven shape, so that the light receiving level of the specular reflection light component is decreased with the toner deposition amount.

The diffused light component is substantially zero level in the case where it is incident on the mirror surface portion. With the deposition of the toner, the toner surface causes the diffused reflection, so that the light receiving level of the different light component is increased.

However, with respect to the black toner, the toner itself absorbs the incident light, so that the diffused reflection component in little generated and thus the light receiving level of the diffused light is not substantially changed.

The surface roughness of the intermediary transfer belt 130 is gradually changed by long-term use, so that an output level of the optical sensor 150 fluctuates. Further, the output level of the optical sensor 150 also fluctuates due to deposition of a contaminant on a light receiving surface of the optical sensor 150.

Therefore, with respect to the measured data of each patch image, a process for correcting the influence of the above fluctuation is made by using the measured data at a background position which is the surface of the intermediary transfer belt 130 at a corresponding position.

The output level (background signal) of the optical sensor 150 with respect to the background immediately under the patch image cannot be detected simultaneously with the output level (patch image signal) of the optical sensor 150 with respect to the patch image. For that reason, after the drive of the intermediary transfer belt 130 is stabilized, the background of the intermediary transfer belt 130 in a state in which the toner image is not present at the surface thereof, i.e., the intermediary transfer belt 130 is free from the toner image, is detected in a length corresponding to one full circumference of the intermediary transfer belt 130 and is stored in a memory 118 together with phase information. Then, at the time of patch image detection, the background signal at the same phase stored at the time of the background detection is read from the memory 118, so that the density is obtained by using a formula (1) shown below.

That is, when a read value of the background (background signal) is represented by Sbase and a read value of the patch (patch image signal) is represented by Spatch, a conversion density (Dpatch) is obtained by the following formula (1):

$$Dpatch = Spatch / Sbase \quad (1)$$

(Detecting Means Selection Control)

The driving roller 131, the tension roller 132 and the follower roller 133 around which the intermediary transfer belt 130 is extended are disposed in parallel with each other. However, when there are tolerance of parts, deviation of alignment, a difference in circumferential length between the end portions of the intermediary transfer belt 130, the intermediary transfer belt 130 is moved toward one end portion with respect to the main scan direction of the intermediary transfer belt 130.

In the case where the constitution in which the belt is stretched by the rollers is employed, a mechanism for suppressing (regulating) the lateral deviation generated with respect to the belt is provided in general. The mechanism for generating a force, at the end portion of the toner image carrying intermediary transfer belt 130 in this embodiment, in a direction in which the lateral deviation of the intermediary transfer belt is corrected or alleviated will be described below. In this embodiment, by the regulating rib 140 disposed on the inner circumferential surface of the intermediary transfer belt and the regulation member 141 provided at the end portion of the tension roller 132 with respect to the main scan direction, the movement of the intermediary transfer belt 130 in the main scan direction is prevented. As a result, the position of the intermediary transfer belt 130 is regulated in a state in which the regulating rib 140 provided at the end portions of the belt is located in the neighborhood of the regulation member 141. This lateral deviation direction varies, as described above, depending on the position relationship among the three axes of the driving roller 131, the tension roller 132 and the follower roller 133, and the characteristic of the intermediary transfer belt alone. Therefore, the lateral deviation direction is relatively stable when these members are incorporated in the apparatus main assembly and a combination of parts is not changed. Incidentally, with respect to the mechanism for generating the force in the belt lateral deviation correcting direction, another known constitution may also be employed.

In the case where of the intermediary transfer belt 130 is laterally deviated toward the one end side with respect to the main scan direction of the intermediary transfer belt 130, the intermediary transfer belt 130 comes slight bending on its surface.

When the bending described above occurs at an opposing portion where the intermediary transfer belt 130 opposes the optical sensor 150, the background signal is largely fluctuated by vibration of the intermediary transfer belt 130.

The optical sensor 150 may desirably be disposed close to the intermediary transfer belt 150 as an object to be measured in order to obtain a sufficient light receiving amount. However, when the intermediary transfer belt 130 as the object to be measured is moved from a focus position in a direction of depth or when the reflection surface is tilted from the horizontal surface, the output level of the optical sensor 150 with respect to the specular reflection light is remarkably decreased. That is, when the intermediary transfer belt 130 is vertically vibrated or waved by the bending of the intermediary transfer belt 130, the background signal fluctuates irregularly. Particularly, with respect to a highlight patch image with a small toner amount, an error of the resultant density information becomes large by the vibration of the intermediary transfer belt 130.

Therefore, in the conventional image forming apparatus in which only one of the optical sensors provided in the neighborhood of the end portions of the image area of the intermediary transfer belt with respect to the main scan direction is used as the density detecting sensor, accuracy of the density correction control is lowered in some cases depending on the lateral deviation direction of the intermediary transfer belt.

In this embodiment, the image forming apparatus 100 effects the registration control by using the two optical sensors 150L and 150R disposed in the neighborhood of the end portions of the image area L of the belt-like image bearing member 130 and also effects the density correction control by using the same optical sensors 150L and 150R. One of objects of this embodiment is to prevent the lowering in accuracy of the density correction control due to the vibration of the belt-like image bearing member 130 occurring at the opposing portion, where the member 130 opposes the optical sensors 150L and 150R, depending on the lateral deviation position of the member 130 in the image forming apparatus 100.

In this embodiment, a mode (sensor selection mode) in which variances of the background signals obtained by the two optical sensors 150L and 150R disposed at positions corresponding to the end portions of the intermediary transfer belt 130 with respect to the main scan direction are compared with each other and thus the optical sensor used for the density correction control is selected is provided.

Figure 2:
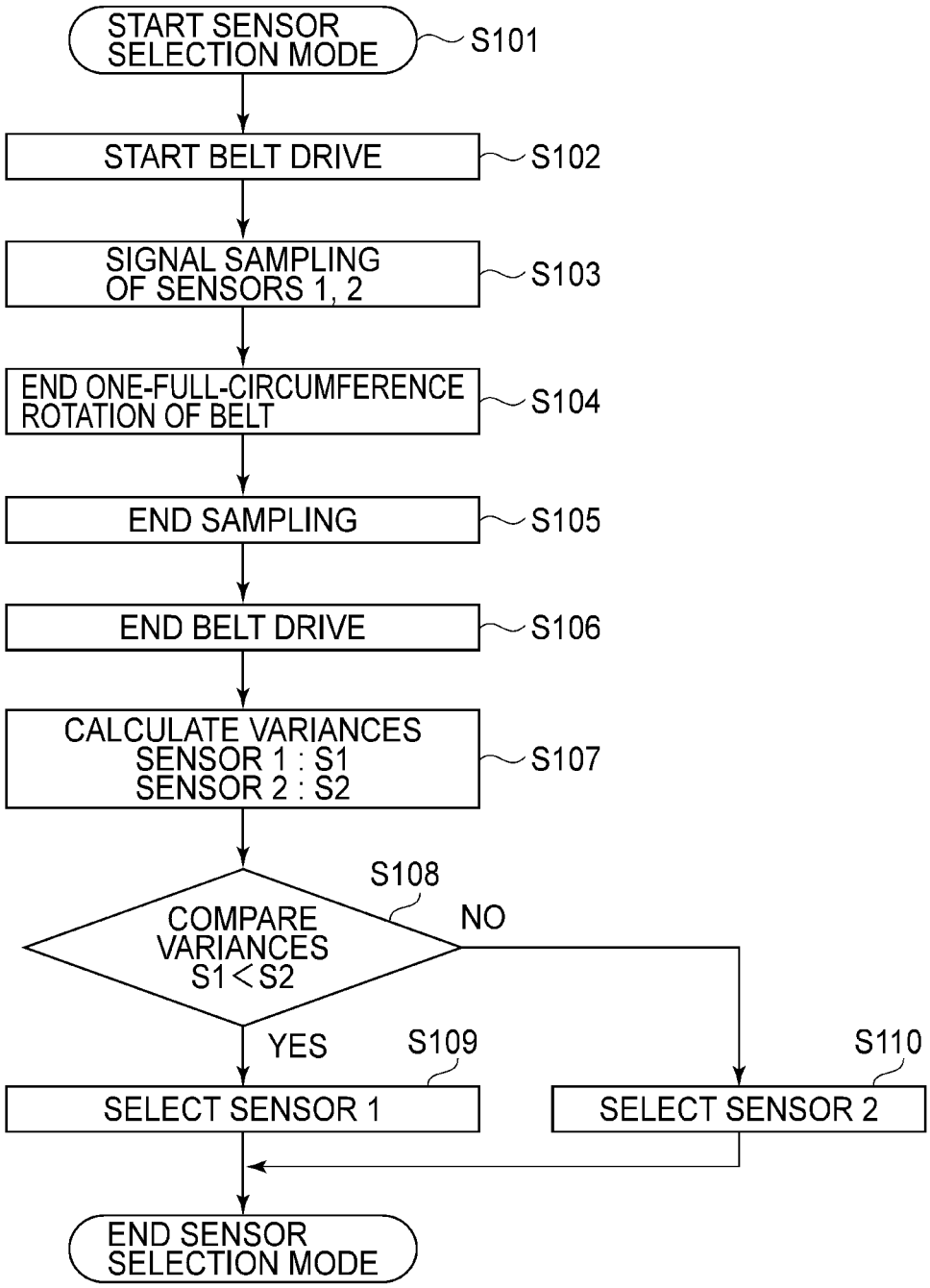
FIG. 2 is a flowchart for illustrating selection control of a density sensor in Embodiment 1.

An operation in the sensor selection mode (detecting means selection control) will be described with reference to FIG. 2. In this embodiment, the control of the sensor selection mode is, in accordance with a program or data stored in the memory as the storing means, executed by a CPU as a processing device in the control portion (controller) 160 as a control device for effecting centralized control of the image forming apparatus 100.

When the sensor selection mode is selected (S101), drive of the motor of the apparatus main assembly is started and the drive of the intermediary transfer belt 130 is started (S102). After about 1000 msec necessary for steady rotation of the intermediary transfer belt, sampling of the surface of the intermediary transfer belt 130 by the first optical sensor 150L (sensor 1) and the second optical sensor (sensor 2) is stored (S103). The sampling is performed at an interval of 20 msec similarly as during normal density correction control. The background signal can be detected from both of the specular reflection light and the diffused light but flappering of the intermediary transfer belt 130 largely affects the specular reflection light, so that the sampling of the specular reflection light may only be required to be made in the sensor selection mode.

When the rotation of the intermediary transfer belt 130 in a length corresponding to one full circumference is detected (S104), the sampling by the first and second optical sensors 150L and 150R (sensors 1 and 2) is completed (S105) and then the drive of the intermediary transfer belt 130 is completed (S106). Then, a variance S of the background signal of the specular reflection light component is computed (S107).

Figure 3:
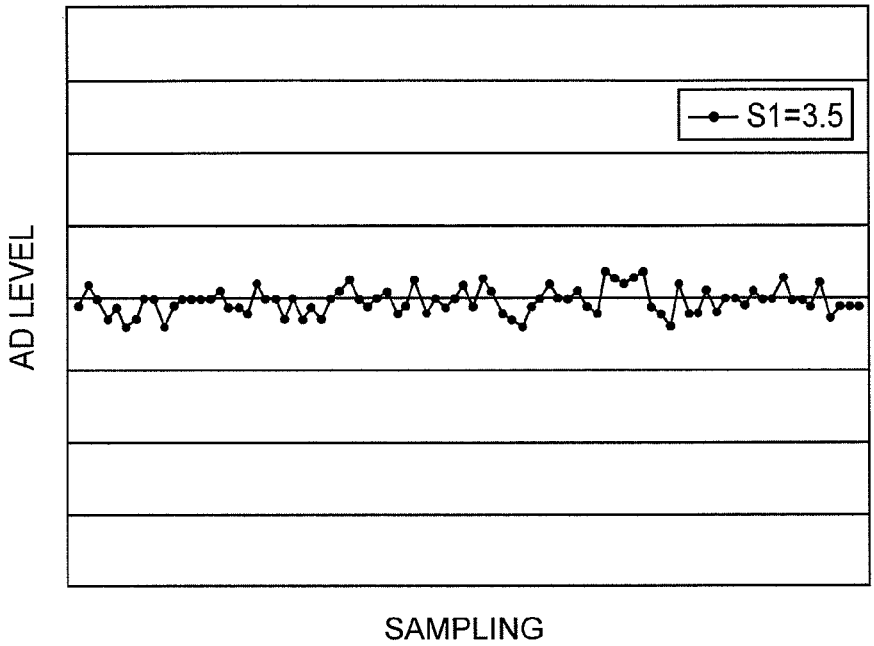
FIGS. 3(*a*), 3(*b*), 4(*a*), 4(*b*), 5(*a*) and 5(*b*) are graphs each for illustrating an example of a background signal obtained by the density sensor.
Figure 3:
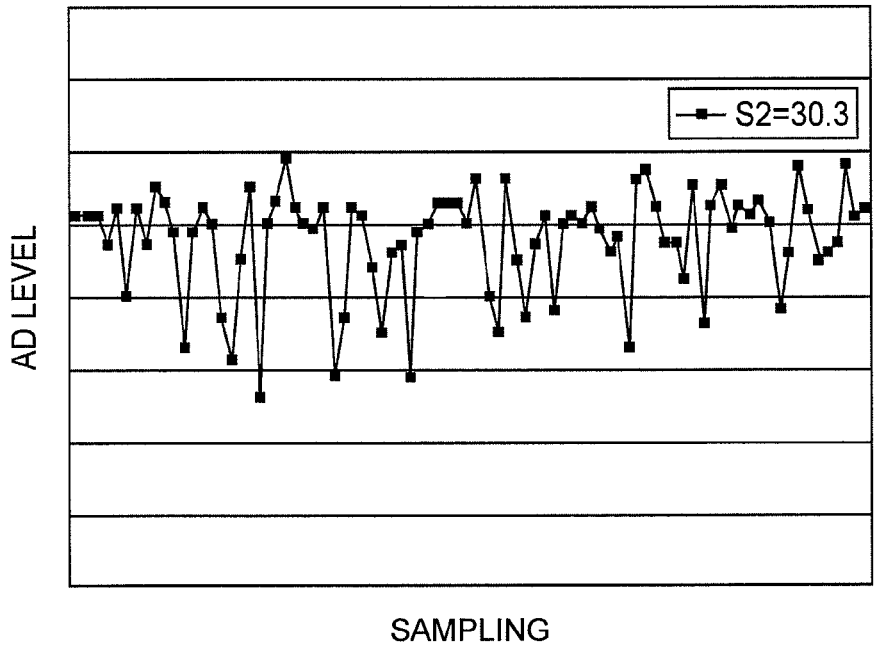

FIGS. 3(*a*) and 3(*b*) are graphs showing partly extracted signal values obtained by the sampling by the first and second optical sensors 150L and 150R, respectively. An ordinate represents an output value of the specular reflection light component after AD conversion of the sampled background signal, and an abscissa represents time.

As shown in FIGS. 3(*a*) and 3(*b*), irregular vibration is observed in the detected background signal of the specular reflection light component and there is difference in amplitude of the vibration of the intermediary transfer belt 130 at the end portions with respect to the main scan direction.

The vibration of the intermediary transfer belt 130, as described above, detected as variation of the background signal and therefore the variance S is obtained from the sampled signal value. The variance S was obtained from an i-th sampling signal Si and an average Save of Si according to the following formula (2):

$$S=\Sigma(Si-\mathrm{Save})2/i \qquad (2).$$

Then, the resultant variances are compared with each other (S108), and the optical sensor providing smaller variance, i.e., the optical sensor providing a smaller degree of non-uniformity of the measurement result of the surface of the intermediary transfer belt 130 is selected (S109, S110).

In this embodiment, variance S1 for the first optical sensor 150L (sensor 1) shown in FIG. 3(*a*) was 3.5, and variance S2 for the second optical sensor 150R (sensor 2) was 30.3. Therefore, S1<S2 is satisfied (S108), so that the first optical sensor 150L is selected (S109) and then the sensor selection mode is ended.

The information of the selected optical sensor is stored in the memory of the control portion 160. Until a subsequent sensor selection mode is actuated, good density correction control can be carried out by using the first optical sensor 150L selected as described above.

Figure 12:
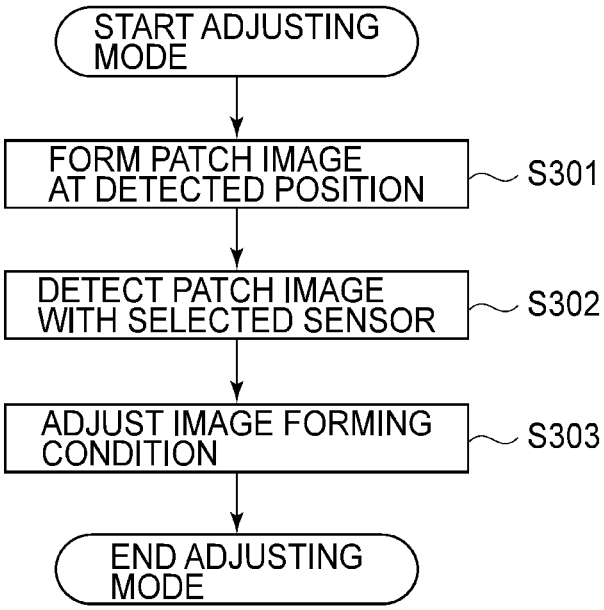
FIG. 12 is a flowchart for illustrating density correction control using a selected density sensor.

As shown in FIG. 12, during the execution of the image density control, the CPU of the control portion 160 reads out the information of the currently selected optical sensor and effects control so that the patch image is formed at a detected position of the intermediary transfer belt 130 by the selected optical sensor (S301). Then, the background signal and the patch image on the intermediary transfer belt 130 are detected by the currently detected optical sensor (S302). On the basis of a detection result, adjustment of the image forming condition, i.e., preparation of a correction table in this embodiment is made (S303). Incidentally, the operation in the density correction control is as described above with reference to FIG. 9.

The actuating timing of the sensor selection mode can be set as follows. First, e.g., in the case where the apparatus main assembly is mounted or in the case where a unit of the intermediary transfer belt 130 is exchanged, the sensor selection mode may preferably be automatically actuated.

Figure 11:
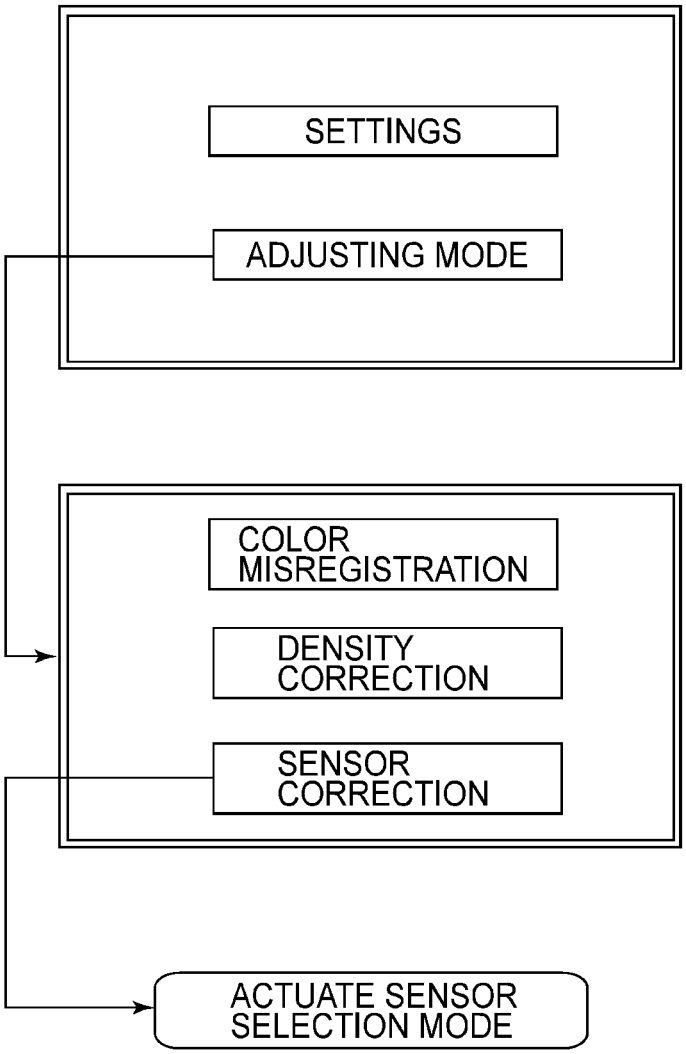
FIG. 11 is a schematic diagram for illustrating an actuating method of density sensor selection control by a manual operation.

Further, a user may actuate the sensor selection mode with arbitrary timing by providing the actuation instruction through an operating portion (not shown) provided on the apparatus main assembly. For example, as shown in FIG. 11, on a setting screen displayed on a touch panel as the operating portion, "adjusting mode" is selected and then "sensor correction" is selected on a mode selection screen which is subsequently displayed as a lower-level screen, so that the sensor selection mode can be actuated.

Further, the background signal can be sampled with timing at which there is no need for output of the optical sensor 150 during not only particularly the execution of the sensor selection mode but also execution of another control such as adjustment of the primary transfer bias or adjustment of the potential of the photosensitive drum. Then, the variance of the sampled background signal is obtained and can be utilized as a "current value". For example, the variance obtained in a preceding sensor selection mode is stored as a "reference value" and in the case where the "current value" obtained during the execution of the above-described another control is larger than the "reference value" by more than a predetermined threshold, the sensor selection mode can be actuated. Alternatively, in the similar case, it is also possible to urge the user to actuate the sensor selection mode by display or the like on the operating portion.

As described above, in the conventional image forming apparatus, only one of the two optical sensors provided at the end portions of the intermediary transfer belt with respect to the main scan direction has been used as the density detecting sensor. In this case, the density detection accuracy at the highlight portion was lowered in the state in which the background of the intermediary transfer belt was vibrated, so that sufficient density stability was not able to be obtained in some cases. On the other hand, in this embodiment, in the sensor selection mode, even in a state in which the background of the intermediary transfer belt is vibrated, good density stability can be obtained by selecting the optical sensor for which the background vibration is small and which provides higher detection accuracy.

Embodiment 2

In this embodiment, basis constitution and operation of the image forming apparatus are identical to those in Embodiment 1. Therefore, constituent elements having the same or corresponding functions and constitutions as those in Embodiment 1 are represented by the same reference numerals or symbols, thus being omitted from detailed description.

For the purpose of realizing downsizing of the image forming portions or because of less occurrence of ozone, as the charging means of the image forming portion, a charging roller which is a charging member is used in many cases.

Further, as the high voltage (charging bias) to be applied to the charging roller, a voltage in the form of a DC component as a setting potential biased (superposed) with an AC component for potential convergence has been frequently used since an amount of occurrence of ozone is smaller than that in corona charging.

In this embodiment, as the charging means, a charging roller 2 prepared by forming, on a core metal of 6 mm in outer diameter, a sponge layer of EPDM and a fluorine-containing coating layer in this order so as to have an outer diameter of 14 mm was used.

During the image formation, in order to obtain a predetermined photosensitive drum potential, as the charging bias, a superposed voltage (AC bias) having a frequency of 1400 Hz, Vpp=1600 V and DC=−650 V was applied.

In the case where the AC bias is applied to the charging roller 2, the photosensitive drum 3 is vibrated by the application of the AC component, so that the vibration is transmitted to the intermediary transfer belt 130. At this time, the vibration is also observed at the opposing portion when the intermediary transfer belt 130 opposes the optical sensor 150. Further, as described in Embodiment 1, when the intermediary transfer belt 130 was laterally deviated in the main scan direction, it was found that the flappering of the intermediary transfer belt 130 is larger in amplitude during the application of the AC voltage to the charging roller 2 than during no application of the AC voltage to the charging roller 2.

Thus, with respect to the flappering of the intermediary transfer belt 130, even in the case where the difference in degree of the flappering between the end portions with respect to the main scan direction when the AC voltage is not applied to the charging roller 2 which is the vibration member, the difference becomes large by the application of the AC voltage. Therefore, a preferred optical sensor 150 in the density correction control is liable to be selected.

However, when the AC voltage is applied to the charging roller 2, deterioration of the surface layer of the photosensitive drum 3 by discharging energy is liable to be accelerated. For that reason, it is preferable that the deterioration of the photosensitive drum 3 is prevented from proceeding by increasing an application time of the AC voltage during non-image formation.

In this embodiment, in the sensor selection mode, a voltage different in condition from that during the image formation is applied to the charging roller 2.

Figure 10:
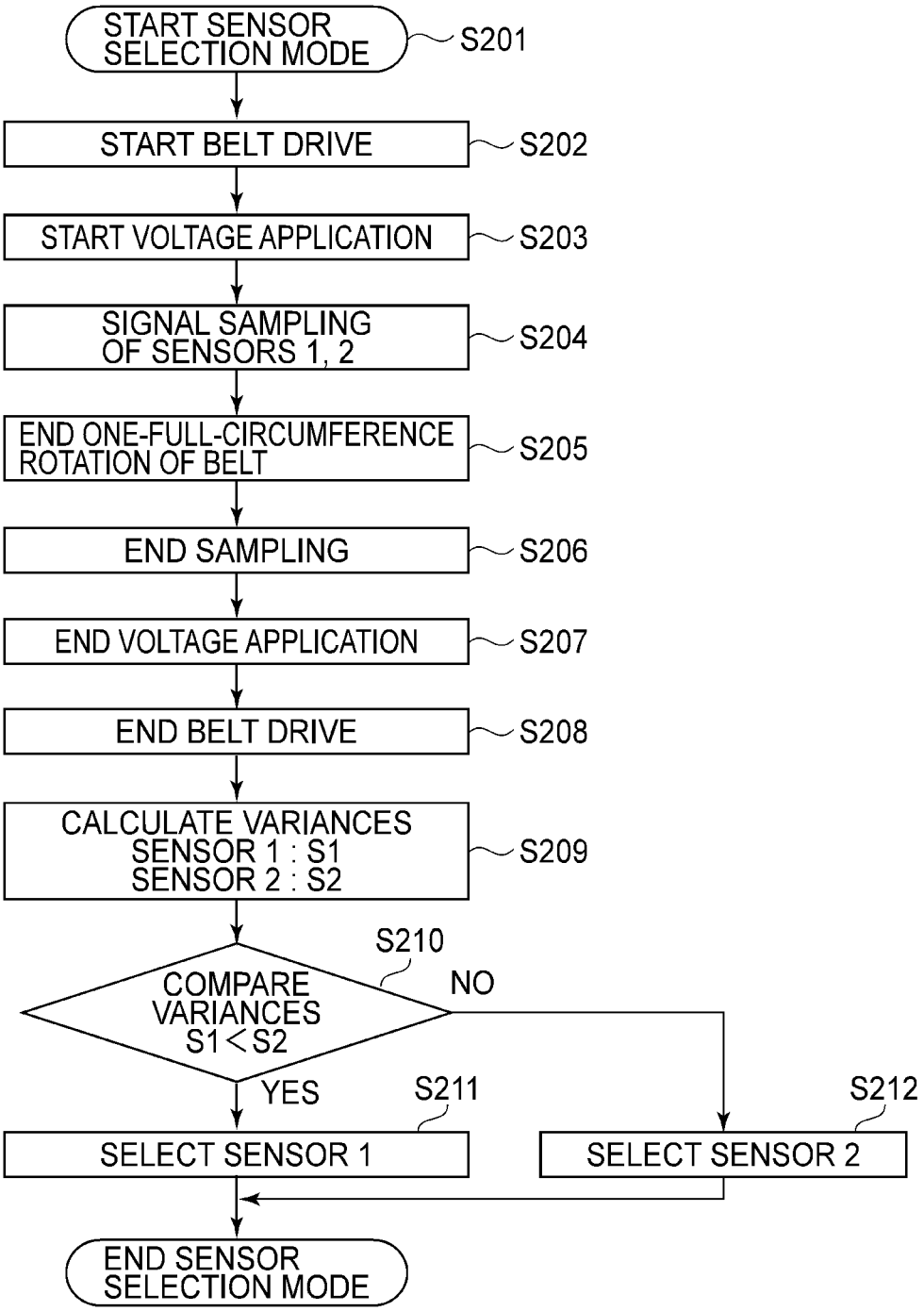
FIG. 10 is a flowchart for illustrating selection control of a density sensor in Embodiment 2.

FIG. 10 is a flowchart of the control in the sensor selection mode in this embodiment. When the sensor selection mode is actuated (S201), the drive of the intermediary transfer belt 130 is started (S202) and then the charging bias is applied to the charging roller 2 (S203). In this embodiment, the charging bias having the frequency of 1400 Hz, Vpp=1000 V and DC=0 V in the sensor selection mode was used. At this bias setting, compared with during the image formation, damage on the photosensitive drum 3 is less. That is, in the sensor selection mode, to the charging roller 2 as the vibration member, the AC vibration which is smaller in peak-to-peak voltage than that during the image formation is applied. Further, in place of or in addition to the peak-to-peak voltage, it is also possible to apply the AC voltage which is smaller in frequency than that during the image formation in the sensor selection mode.

In the state in which the charging bias is applied, after the intermediary transfer belt 130 is steadily rotated, the sampling of the surface of the intermediary transfer belt 130 by the first and second optical sensors 150L and 150R is started (S204).

Figure 4:
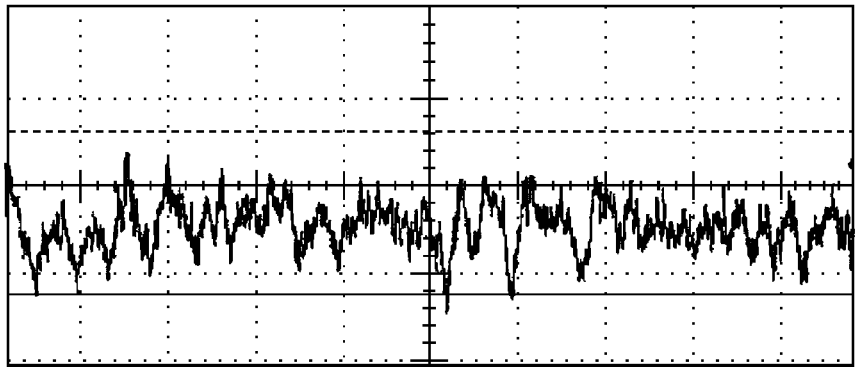
Figure 4:
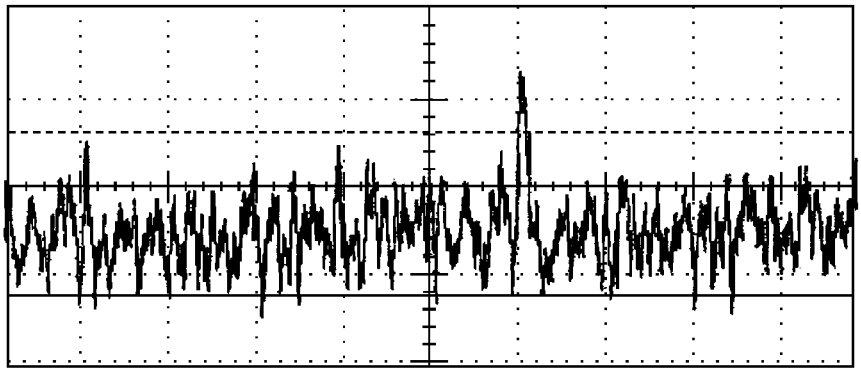

FIGS. 4(*a*) and 4(*b*) show values of the background signals of the first and second optical sensors 150L and 150R, respectively, in the state in which the charging bias is not applied to the charging roller 2. The ordinate represents signal intensity, and the abscissa represents time. FIGS. 4(*a*) and 4(*b*) are background signal waveforms before AD conversion. The background signal waveform shown in FIG. 4(*a*) has the variance S of 6.2, and the background signal waveform shown in FIG. 4(*b*) has the variance S of 5.8, so that there is no so significant difference.

Figure 5:
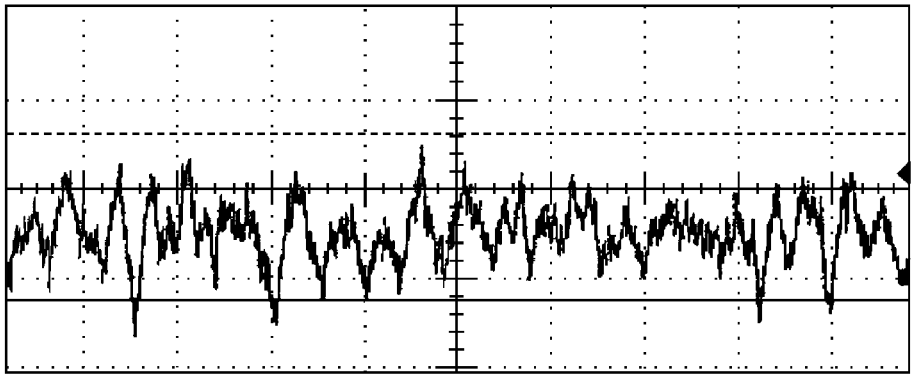
Figure 5:
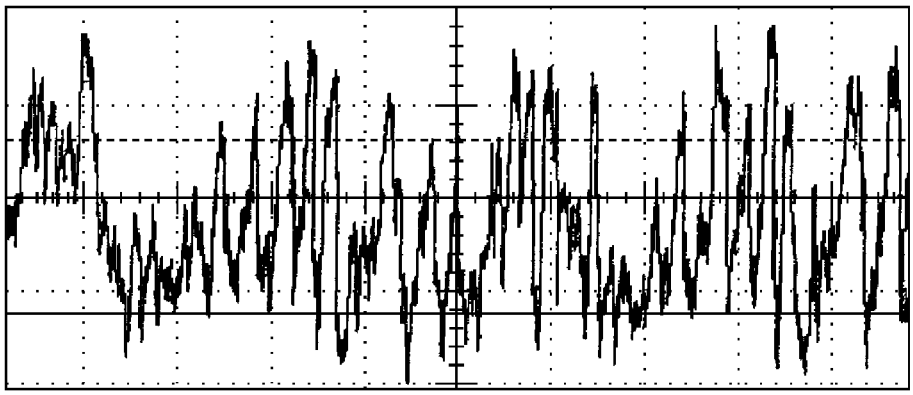

On the other hand, FIGS. 5(*a*) and 5(*b*) show values of the background signals of the first and second optical sensors 150L and 150R, respectively, in the state in which the charging bias is applied to the charging roller 2. The background signal waveform shown in FIG. 5(*a*) corresponds to that after being changed from that shown in FIG. 4(*a*), and the background signal waveform shown in FIG. 5(*b*) corresponds to that after being changed from that shown in FIG. 4(*b*). The ordinate represents signal intensity, and the abscissa represents time. FIGS. 5(*a*) and 5(*b*) are background signal waveforms before AD conversion. The background signal waveform shown in FIG. 4(*a*) has the variance S of 6.3, and the background signal waveform shown in FIG. 4(*b*) has the variance S of 22.5.

Thus, when the charging bias including the AC component is applied to the charging roller 2, larger vibration is observed at a portion where the intermediary transfer belt 130 causes bending. As a result, even in the case where only a less discriminable output can be obtained in the state in which the charging bias is not applied, the discrimination of the optical sensor suitable for the density correction control becomes easy.

After the intermediary transfer belt 130 is rotated by a distance corresponding to one full circumference (S205), the sampling by the first and second optical sensors 150L and 150R is ended (S206), and the application of the charging bias to the charging roller 2 is ended (S207). Then, the drive of the intermediary transfer belt 130 is ended (S208) and thereafter the variance of the background signal with respect to the specular reflection light component is computed (S209). Then, the resultant values of the variance are compared with each other (S210), so that the optical sensor providing smaller variance is selected (S211, S212).

The information of the selected optical sensor is stored in the memory of the control portion 160. Until the actuation of a subsequent sensor selection mode, the current stored optical sensor which has been selected as the optical sensor 150 used for the density correction control is used to effect the density correction control. Similarly as in Embodiment 1 described with reference to FIG. 12, in the image density correction control, the patch image is formed on the intermediary transfer belt 130 at the detection position by the selected optical sensor and then the optical sensor and the patch image are detected by the optical sensor. On the basis of the detection result, the image forming condition is adjusted. Incidentally, an operation in the density correction control is as described in Embodiment 1 with reference to FIG. 9.

Here, when the bias application and the driving operation are performed in the sensor selection mode under the same condition as that during the image formation, it would be considered that a decrease in lifetime of the photosensitive drum 3 or the developer is caused in some cases. However, as in this embodiment, by effecting the bias control and the drive control under the condition different from that during the image formation, it is possible to prevent the occurrence of the decrease in lifetime.

As described above, by measuring the background signal in the state in which the vibration is transmitted from the vibration member to the intermediary transfer belt 130 in the sensor selection mode, the vibration of the intermediary transfer belt 130 can be detected in a short time with further accuracy and thus the optical sensor used in the density correction control can be selected.

Incidentally, in this embodiment, the charging means is used as the vibration member and in the sensor selection mode, the vibration is transmitted from the charging means to the intermediary transfer belt 130. However, the present invention is not limited thereto. For example, an AC voltage in the form of superposition of the AC voltage and the DC voltage is applied as a developing bias to the developer carrying member such as the developing roller of the developing device 1 is applied during the image formation. Therefore, by using the developer carrying member of the developing device 1 as the vibration member, the vibration can be transmitted to the intermediary transfer belt 130 in the sensor selection mode. Further, to the primary transfer means and the secondary transfer means, the DC voltage is generally applied as the transfer bias during the image formation but it is also possible to apply a bias including the AC component to these transfer means. Therefore, by using the primary and secondary transfer means as the vibration member, in the sensor selection mode, it is possible to transmit the vibration to the intermediary transfer belt 130. Further, it is also possible to transmit the vibration to the intermediary transfer belt 130 in the sensor selection mode by using, as the vibration member, either one or a plurality of members selected from the charging means, the developing means, the primary transfer means and the secondary transfer means. Further, it is possible to apply the bias including the AC component to either one or a plurality of the members selected from the charging means, the developing means, the primary transfer means and the secondary transfer means in the sensor selection mode under a different condition or combination from that during the image formation. Typically, either one or both of the peak-to-peak voltage and the frequency of the AC voltage to be applied to the vibration member are made smaller than those during the image formation when the detecting means selection control is effected. As a result, it is possible to prevent the acceleration of the deterioration of the photosensitive drum and intermediary transfer belt.

Embodiment 3

In Embodiments 1 and 2, the case where the belt for carrying the toner image is the intermediary transfer belt is described as an example. However, the present invention is not limited thereto. Specifically, in the constitution in which the mechanism for applying the force, to the belt end portion, in the direction in which the lateral deviation of the belt is corrected, it is also possible to employ a constitution in which the toner image density can be detected on the belt. In this embodiment, the constituent elements of the image forming apparatus having similar constitutions and functions to those in Embodiment 1 are represented by the same reference numerals or symbols, thus being omitted from description.

In this embodiment, a constitution in which a photosensitive member belt is charged and exposed to light to form an electrostatic image thereon, and then the formed electrostatic image is developed by the developing device will be described as an example.

Figure 13:
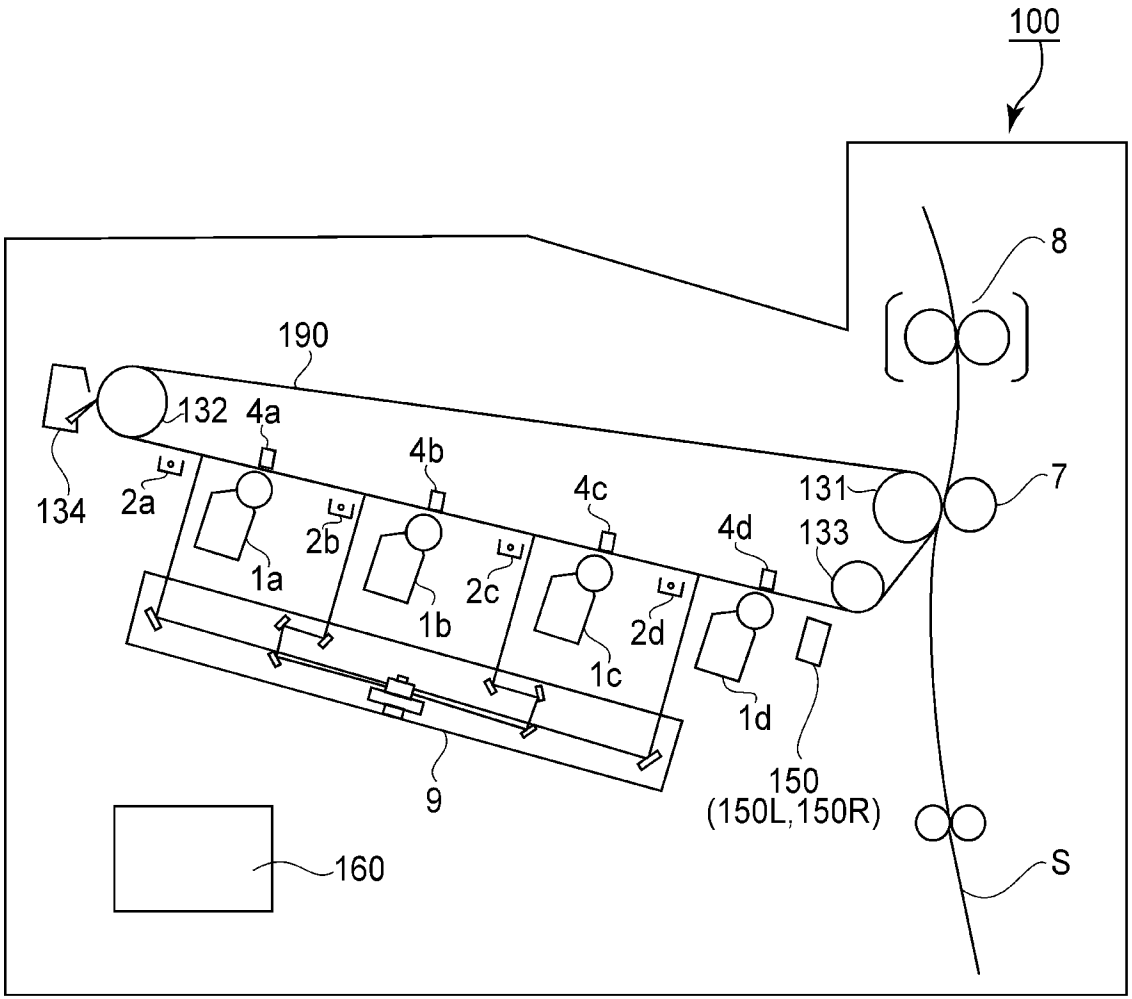
FIG. 13 is a schematic view for illustrating a structure of an image forming apparatus including a photosensitive belt.

FIG. 13 is a schematic view for illustrating a structure of the image forming apparatus in this embodiment. Incidentally, it is also possible to form the toner image on the belt of another know image forming type.

The image forming apparatus in this embodiment includes a photosensitive member belt 190 as the image bearing member including the photosensitive layer. The photosensitive member belt 190 is charged by a non-contact corona charger 2*a* as the charging means, and the electrostatic image is formed on the photosensitive member belt by the exposure device 9. Then, the electrostatic image formed on the photosensitive member belt is developed at a developing portion formed by the developing device 1*a* and a back-up member 4*a*. Thus, the toner images are formed on the photosensitive member belt by the respective developing devices 1*b*, 1*c* and 1*d* and are transferred from the photosensitive member belt onto the sheet at a transfer portion formed by the rollers 131 and 7. The toner images transferred on the sheet are fixed by the fixing device 8, and the sheet is discharged outside the image forming apparatus.

Further, the photosensitive member belt 190 is provided with a rib, for regulating the lateral deviation of the belt, at a stretching surface (inner surface) side of thereof, so that the lateral deviation of the photosensitive member belt 190 is regulated. Further, the toner images formed on the photosensitive member belt are detected by the optical sensor 150 (150L, 150R) disposed downstream of the developing device 4*d* and upstream of the transfer portion with respect to the rotational direction of the photosensitive member belt. Here, the optical sensors 150L and 150R do not detect the toner images at an opposing position in which the photosensitive member belt opposes the stretching roller 133. That is, the optical sensor 150 in this embodiment is disposed at a position in which the optical sensor 150 is liable to be influenced by the vibration generated due to the regulation of the belt lateral deviation.

In such a constitution, the patch image is formed and is subjected to the control described in Embodiments 1 and 2 by which the image forming condition such as the charging condition of the charging device, the developing condition of the developing device, or the exposure condition of the exposure device.

The present invention is not limited to the above-described embodiments. For example, in the conventional image forming apparatus, such a constitution that a rotatable belt-like recording material carrying member, i.e., a conveyer belt is disposed opposed to the plurality of image forming portions and is used as a recording material carrying member for carrying and conveying the recording material, and the images formed by the plurality of image forming portions are successively transferred onto the recording material carried on the conveyer belt is employed. In the conventional image forming apparatus, in the same manner as in Embodiments 1 to 3 described above in which the test toner image is formed on the surface of the intermediary transfer belt, the test toner image is formed on the surface of the conveyer belt and is optically detected, so that it is possible to effect the image density correction control and the registration control. In this case, the conveyer belt functions as the belt-like image forming member but similarly as in the intermediary transfer belt in Embodiments 1 to 3 described above, the conveyer belt is laterally deviated to cause the flappering, so that the detection accuracy of the test toner image can be lowered. Therefore, the present invention can be applied to such a conventional image forming apparatus, so that it is possible to execute the sensor selection mode in which the optical sensor providing smaller degree of variation of the measurement result of the conveyer belt surface is selected from the optical sensors provided in the neighborhood of the end portions of the conveyer belt with respect to the main scan direction. As a result, it is possible to achieve effects similar to those in Embodiments 1 to 3 described above.

While the invention has been described with reference to the structures disclosed herein, it is not confined to the details set forth and this application is intended to cover such modifications or changes as may come within the purpose of the improvements or the scope of the following claims.

This application claims priority from Japanese Patent Applications Nos. 249257/2009 filed Oct. 29, 2009 and 217865/2010 filed Sep. 28, 2010, which are hereby incorporated by reference.

What is claimed is:

1. An image forming apparatus comprising:

a belt;

a plurality of rollers for stretching said belt;

a mechanism for generating a force, at an end portion of said belt, in a direction in which lateral deviation of said belt is corrected;

a forming device for forming a toner image on said belt;

a first sensor capable of detecting a density of the toner image formed on said belt on one end side of said belt;

a second sensor capable of detecting the density of the toner image formed on said belt on the other end side of said belt; and a control device for selecting one of said first and second sensors which provides a smaller variation in a result of detection when said belt is free from the toner image, and for controlling an image forming condition of said forming device on the basis of a detection result of the density of the toner image by said selected sensor.

2. An apparatus according to claim 1, wherein said control device controls, when said first sensor provides the smaller variation of the detection result than said second sensor, said forming device so that a toner image used for adjusting a forming condition is formed in a detection range of said first sensor without being formed in a detection range of said second sensor.

3. An apparatus according to claim 1, further comprising a vibration member which vibrates by being supplied with an AC voltage, wherein the detection result has been obtained by detection in a state in which the vibration is transmitted from said vibration member to said belt.

4. An apparatus according to claim 3, wherein at least one of a peak-to-peak voltage and a frequency of the AC voltage supplied to said vibration member when the detection result is obtained are smaller than a corresponding one of a peak-to-peak voltage and frequency of the AC voltage supplied to said vibration member during image formation.

5. An apparatus according to claim 1, wherein each of said first sensor and said second sensor is an optical sensor including a light emitting portion, a first light receiving portion provided at a first position in which it receives specular reflection light of light emitted from said light emitting portion to said belt, and a second light receiving portion provided at a second position, different from the first position, in which it receives diffused reflection light of light emitted from said light emitting portion to said belt.

6. An apparatus according to claim 1, wherein said forming device includes a photosensitive member, a charging device for charging said photosensitive member, an exposure device for forming an electrostatic image by exposing to light said photosensitive member charged by said charging device, a developing device for developing the electrostatic image formed on said photosensitive member into a toner image with toner, and a transfer device for transferring the toner image formed on said photosensitive member onto said belt.

7. An apparatus according to claim 1, wherein said belt includes a photosensitive layer, and wherein said forming device includes a charging device for charging said belt, an exposure device for forming an electrostatic image by exposing to light said belt charged by said charging device, and a developing device for developing the electrostatic image formed on said belt with toner.

8. An apparatus according to claim 1, wherein said mechanism includes a rib contactable to at least one of said plurality of rollers provided at end portions of said belt.

9. An image forming apparatus comprising:

a belt;

a plurality of rollers for stretching said belt;

a mechanism for generating a force, at an end portion of said belt, in a direction in which lateral deviation of said belt is corrected;

a forming device for forming a toner image on said belt;

a first sensor capable of detecting a density of the toner image formed on said belt on one end side of said belt;

a second sensor capable of detecting the density of the toner image formed on said belt on the other end side of said belt; and a control device for controlling an image forming condition of said forming device on the basis of the density of the toner image detected by either one of said first and second sensors, wherein said control device controls the image forming condition of said forming device on the basis of an output of said sensor formed on the end side opposite from the end side where the force generated by said mechanism in the direction in which the lateral deviation of said belt is corrected is applied largely.

* * * * *